US006206368B1

(12) United States Patent
Kobayashi et al.

(10) Patent No.: US 6,206,368 B1
(45) Date of Patent: Mar. 27, 2001

(54) PAPER TRANSPORT DEVICE WITH ONE ROLLER PAIR

(75) Inventors: Hiroshi Kobayashi; Masayuki Kakuta; Jun Kusakabe; Masaki Deguchi; Yutaka Aso; Kuniaki Araishi; Shigeo Kurando, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/264,702

(22) Filed: Mar. 8, 1999

(30) Foreign Application Priority Data

Mar. 17, 1998 (JP) ..... 10-066644
Mar. 17, 1998 (JP) ..... 10-066645

(51) Int. Cl.[7] ..... B65H 5/06

(52) U.S. Cl. ..... 271/273; 271/10.11; 271/10.13; 271/116; 271/122; 271/264

(58) Field of Search ..... 271/273, 274, 271/264, 314, 116, 122, 10.13, 10.11

(56) References Cited

U.S. PATENT DOCUMENTS 5,024,431 * 6/1991 Shimizu et al. ..... 271/274
5,152,519 * 10/1992 Ifkovits ..... 271/274
5,205,551 * 4/1993 Nagano et al. ..... 271/273
5,842,692 * 12/1998 Rutishauser ..... 271/273
6,038,424 * 3/2000 Nakagawa ..... 271/264

FOREIGN PATENT DOCUMENTS

0138072 * 5/1990 (JP) ..... 271/273

* cited by examiner

*Primary Examiner*—H. Grant Skaggs
(74) *Attorney, Agent, or Firm*—Jordan and Hamburg LLP

(57) ABSTRACT

In a paper transport device, a first roller serving as a separation roller is situated underneath a second roller serving as a document feed roller, together forming a roller pair. A rotary shaft of the separation roller is biased upward toward the document feed roller by means of an elastic element. One end of the rotary shaft is connected to a drive shaft via a coupler while a connecting bar is joined to the other end of the rotary shaft obliquely from above. An extreme end of the connecting bar opposite to the rotary shaft is attached to a support plate fixed to a main body of the paper transport device in such a way that the connecting bar can swing about pivot pin fixed to the support plate. In the paper transport device thus constructed, one end of the rotary shaft fitted to the coupler acts as a point of support, allowing the other end of the rotary shaft to move downward overwhelming an upward-lifting force of the elastic element when forced downward by the connecting bar. In this construction, the separation roller can be separated from and brought into contact with the document feed roller.

20 Claims, 10 Drawing Sheets

PAPER TRANSPORT DEVICE WITH ONE ROLLER PAIR

BACKGROUND OF THE INVENTION

1. Field of the Invention

This invention relates to paper transport devices applicable to document scanners, copying machines, printers, facsimile machines and like apparatus. More particularly, the invention pertains to paper transport devices in which paper, such as an original document or copying paper, is transported in a specified direction by at least one pair of rollers.

2. Description of the Background Art

Referring to FIG. 1, a conventional image forming apparatus, such as a copying machine or a facsimile machine, typically comprises a document tray 610 provided in an upper part of a main body 600, a document feeder 620 which is provided at the right of the document tray 610 (as illustrated in FIG. 1) and has a top cover 621, a scanner 630 provided beneath the document tray 610, an optical unit 640 provided beneath the scanner 630, an image forming unit 650 which is disposed beneath the optical unit 640 and includes a photosensitive drum 651 which produces a toner image from an original image exposed by laser light emitted from the optical unit 640 and transfers the toner image onto paper, a paper feed section 660 which is disposed beneath the image forming unit 650 and includes a paper cassette 661, a fuser assembly 670 provided downstream of the paper feed section 660, and a paper output section 680 provided downstream of the fuser assembly 670, for example.

The original image is read, or scanned, in the following manner. An original document loaded on the document tray 610 is first transferred rearward (rightward as illustrated) as it is successively nipped by a plurality of roller pairs of the document feeder 620. Then, the document feeder 620 reverses the feed direction of the document and ejects it back onto the document tray 610. The scanner 630 scans the original image while the document is being transferred by the document feeder 620.

If the document jams as it is transferred rearward by the document feeder 620 in the image forming apparatus thus constructed, it is necessary to open the cover 621 and remove the document from between the roller pairs located in an upper part of the document feeder 620. If the document feeder 620 employs a multiple sheet feed assembly in which each successive sheet is separated and transported from multiple sheets of an original document stacked on the document tray 610, for example, a jam could occur while a sheet is being transferred toward the rear side of the apparatus. Explained below is how this type of jam has conventionally been dealt with.

FIGS. 2 to 4 are diagrams showing a principal portion (multiple sheet feed assembly) of a conventional paper transport device. This paper transport mechanism is constructed such that a roller 643*f* rotatably mounted in a roller housing 647 can project outward and retract inward through an opening 647*b* formed in an upper surface of the roller housing 647. In this construction, a cylindrical outer surface of the roller 643*f* is caused to partly protrude upward and push against another roller located above (not shown) to thereby grip and transport a sheet of paper. In the event of a paper jam, the roller 643*f* is retracted into the roller housing 647 so that the roller 643*f* is separated from the upper roller, making it possible to remove a sheet which has been seized between the rollers. The construction of this paper transport device is now described in further detail referring to FIGS. 2 to 4.

The roller housing 647 has a pair of side plates 647*a* attached to both ends, and a cover 648 which can be opened and closed is fitted to pivot pins 645*a* provided on both side plates 647*a*.

As depicted in detail in FIGS. 3 and 4, the roller 643*f* is mounted on a roller shaft SF1 which is fitted in vertically extending slots 647*c* formed in the side plates 647*a* attached to the opposite ends of the roller housing 647 so that the roller shaft SF1 can move up and down. When the cover 648 is swung up about the pivot pins 645*a*, the cylindrical outer surface of the roller 643*f* which has partly protruded from the cover 648 through its opening 647*b* is fully retracted into the inner space of the roller housing 647. More particularly, L-shaped levers 647*e* are provided inside the individual side plates 647*a* which are attached to the roller housing 647, each L-shaped lever 647*e* being fitted swingably about a pivot pin 647*d* which is formed at an upper rear part of the corresponding side plate 647*a*, projecting from its inside surface, with one end of the L-shaped lever 647*e* extending toward the roller 643*f* and the other end directed downward. Each end of the roller shaft SF1 is fitted in a hole 647*f* formed in one terminal portion of the L-shaped lever 647*e* that extends toward the roller 643*f*, while a spring 649 is hooked between a projecting pin 647*g* formed at the other terminal portion of the L-shaped lever 647*e* and a pin 648*d* formed on a fixing plate 648*c*, projecting inward from the inside surface of a rear part of the cover 648. The roller shaft SF1 fitted in the holes 647*f* formed in both side plates 647*a* is biased upward by springs 647*p* disposed below the roller shaft SF1 at both ends thereof.

In this construction, when the cover 648 is closed as shown in FIG. 3 (i.e., when the paper transport device is ready to feed the original document), the roller shaft SF1 is pushed upward by the springs 647*p* and, therefore, the roller 643*f* is lifted and part of its cylindrical outer surface is exposed to the outside of the roller housing 647. On the other hand, when the cover 648 is swung up about the pivot pins 645*a* as shown in FIG. 4, each fixing plate 648*c* of the cover 648 shifts rearward so that each spring 649 is pulled rearward and, thus, the downward-directed end (rear end) of each L-shaped lever 647*e* swings clockwise about the pivot pin 647*d* (as illustrated in FIG. 4), overwhelming a pushing force exerted by the relevant spring 647*p*. As a consequence, the roller 643*f* is forced downward and the part of its cylindrical outer surface which has been exposed to the outside of the roller housing 647 is retracted into its inner space. Since the roller 643*f* is separated from its upper roller at this point, an operator can remove the sheet of the document jammed between the two rollers.

The paper transport device of the above-described construction is provided with complicated mechanisms on both sides of the roller 643*f* for moving the roller shaft SF1 upward and downward in interlocked action with the opening and closing of the cover 648. The result of this construction is an increase in overall costs of the paper transport device, and this is one of the factors of cost increase of the conventional image forming apparatus incorporating this type of paper transport device.

The foregoing discussion has focused on how a jam which occurs while the document feeder 620 is transferring a sheet of the original document toward the rear side of the apparatus is dealt with. Explained next is how a jam which occurs while a sheet of the document is being transferred forward is dealt with. When this type of jam has occurred, it is necessary to swing up the document tray 610 about its one side to expose a bottom part of the document feeder 620 and then remove the sheet which has jammed from between a pair of rollers located in the bottom part of the document feeder 620. From this, it is recognized that the conventional paper transport device has required a very complicated procedure for dealing with this type of jam.

Although rollers of each roller pair are held in firm contact with each other in normal paper transport conditions, it is desirable to relieve the rollers of their firm contact when dealing with a jam. Then, after removing a sheet which has jammed in the paper transport device, the rollers of each roller pair must be brought back to firm contact again. Operations for relieving and reestablishing the firm contact have been so complicated because such operations should be performed for each individual roller pair.

It is to be understood that the aforementioned problems are not limited to paper transport devices for transporting an original document but would also occur in various paper transport devices for feeding copying paper, printing paper, or other types of paper.

SUMMARY OF THE INVENTION

In view of the aforementioned problems of the prior art, it is an object of the invention to provide a paper transport device which makes it possible to easily remove paper jammed in a roller pair at low cost.

It is another object of the invention to provide a paper transport device which makes it possible to easily deal with paper jams even when the device incorporates more than one roller pair.

To achieve the aforementioned objects, a paper transport device comprises a first roller mounted at a specified position; and a second roller mounted on a rotary shaft extending substantially parallel to a longitudinal direction of the first roller, one end of the rotary shaft being moved in a direction approximately perpendicular to the longitudinal direction of the first roller so that the second roller is separated from or brought into contact with the first roller.

In another form of the invention, a paper transport device comprises a first roller pair including two first rollers arranged parallel to each other, wherein the first rollers can be brought into tight contact with each other and relieved of their tight contact by external operation, and a second roller pair including two second rollers arranged parallel to each other, wherein the second rollers are brought into tight contact with each other when the first rollers are caused to go into tight contact with each other, and the second rollers are relieved of their tight contact when the first rollers are caused to be relieved of their tight contact.

These and other objects, features and advantages of the invention will become more apparent upon reading the following detailed description in conjunction with the accompanying drawings.

DETAILED DESCRIPTION OF THE PREFERRED EMBODIMENTS OF THE INVENTION

A. General Construction of Image Forming Apparatus

Figure 1:
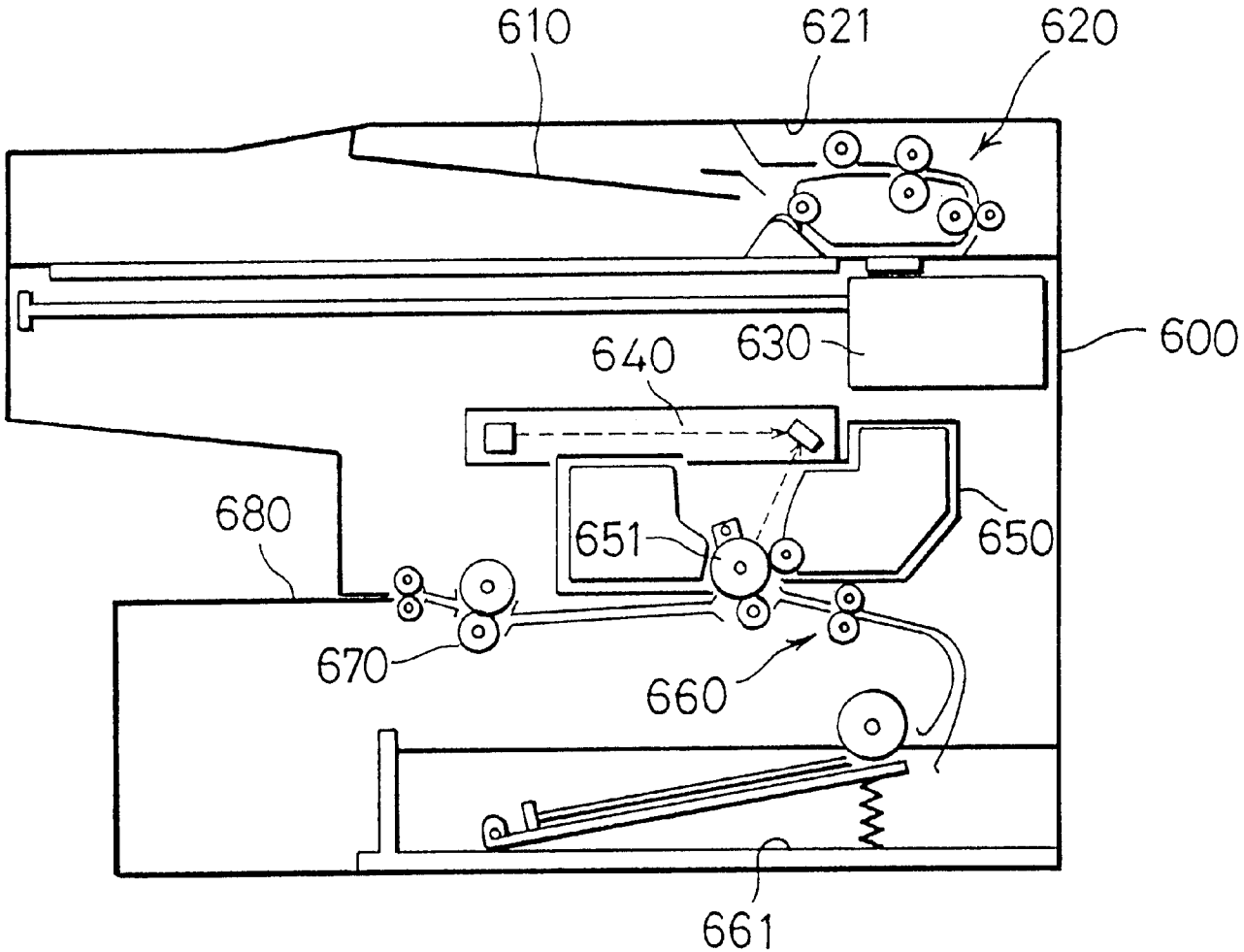
FIG.1(PRIOR ART)
FIG. 1 is a diagram showing an image forming apparatus incorporating a conventional paper transport device.
Figure 2:
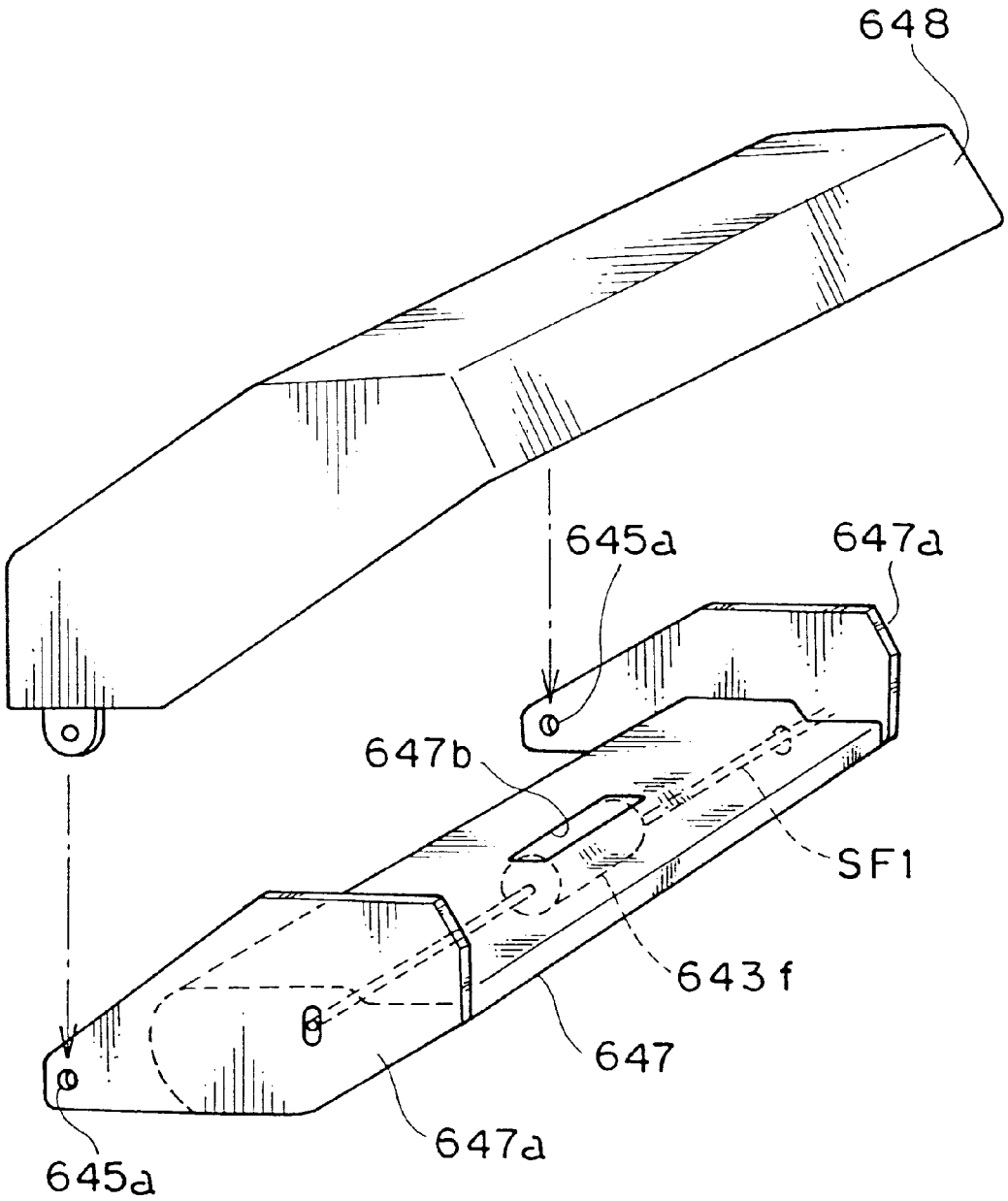
FIG. 2 (PRIOR ART)
FIG. 2 is a diagram showing a multiple sheet feed assembly employed in the conventional paper transport device.
Figure 3:
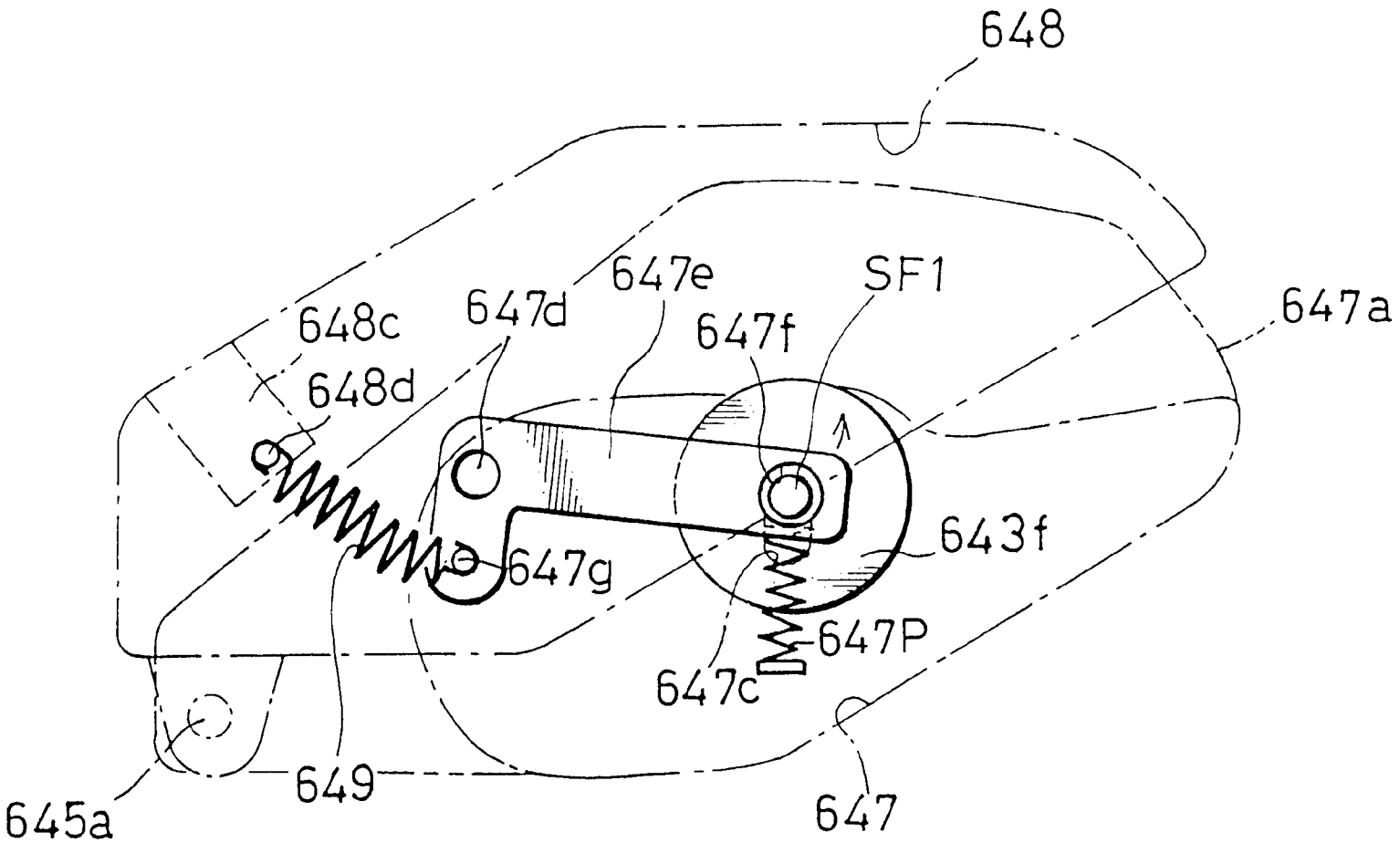
FIG.3(PRIOR ART)
FIGS. 3 and 4 are diagrams showing the operation of the multiple sheet feed assembly of FIG. 2.
Figure 4:
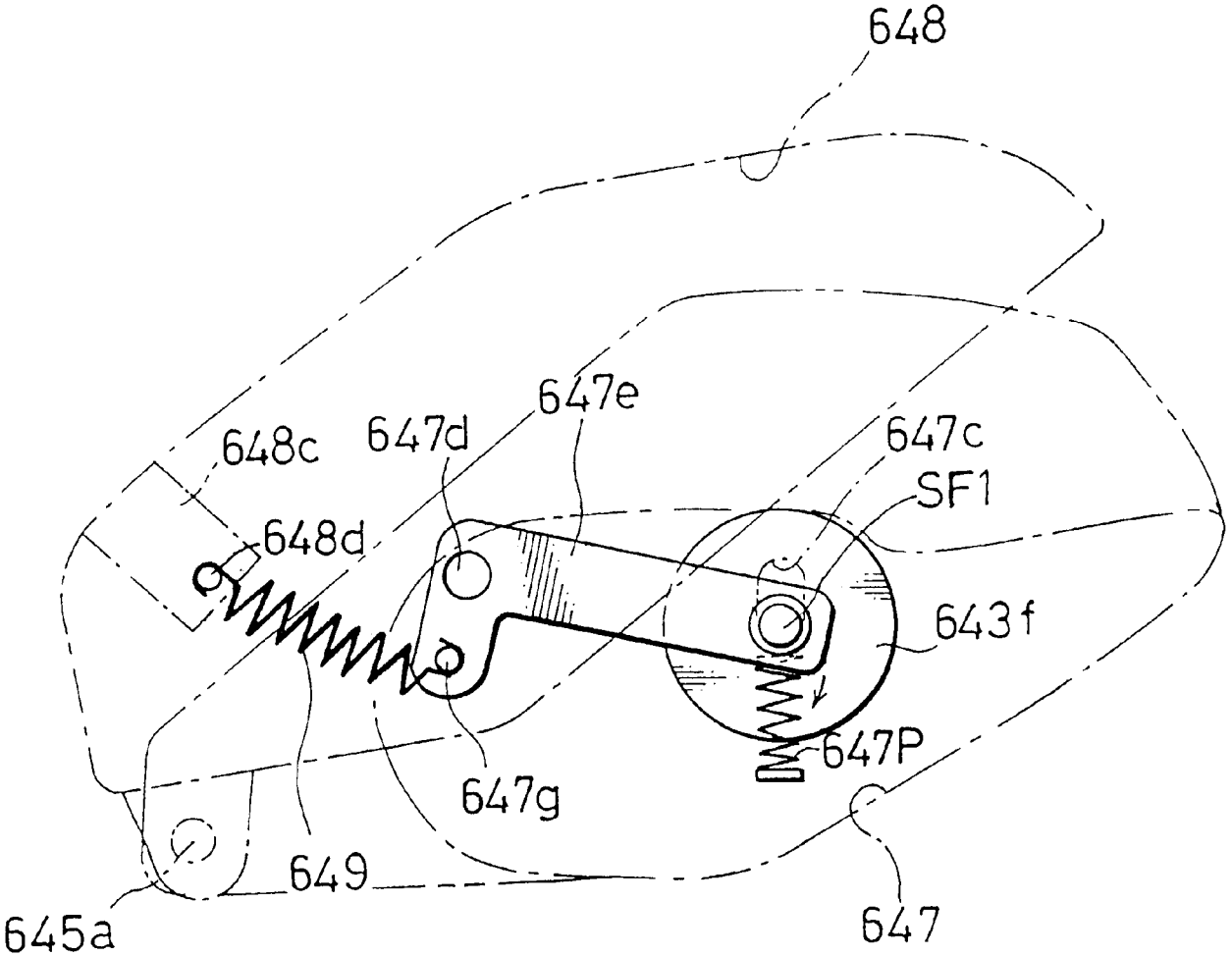
FIG.4(PRIOR ART)
Figure 5:
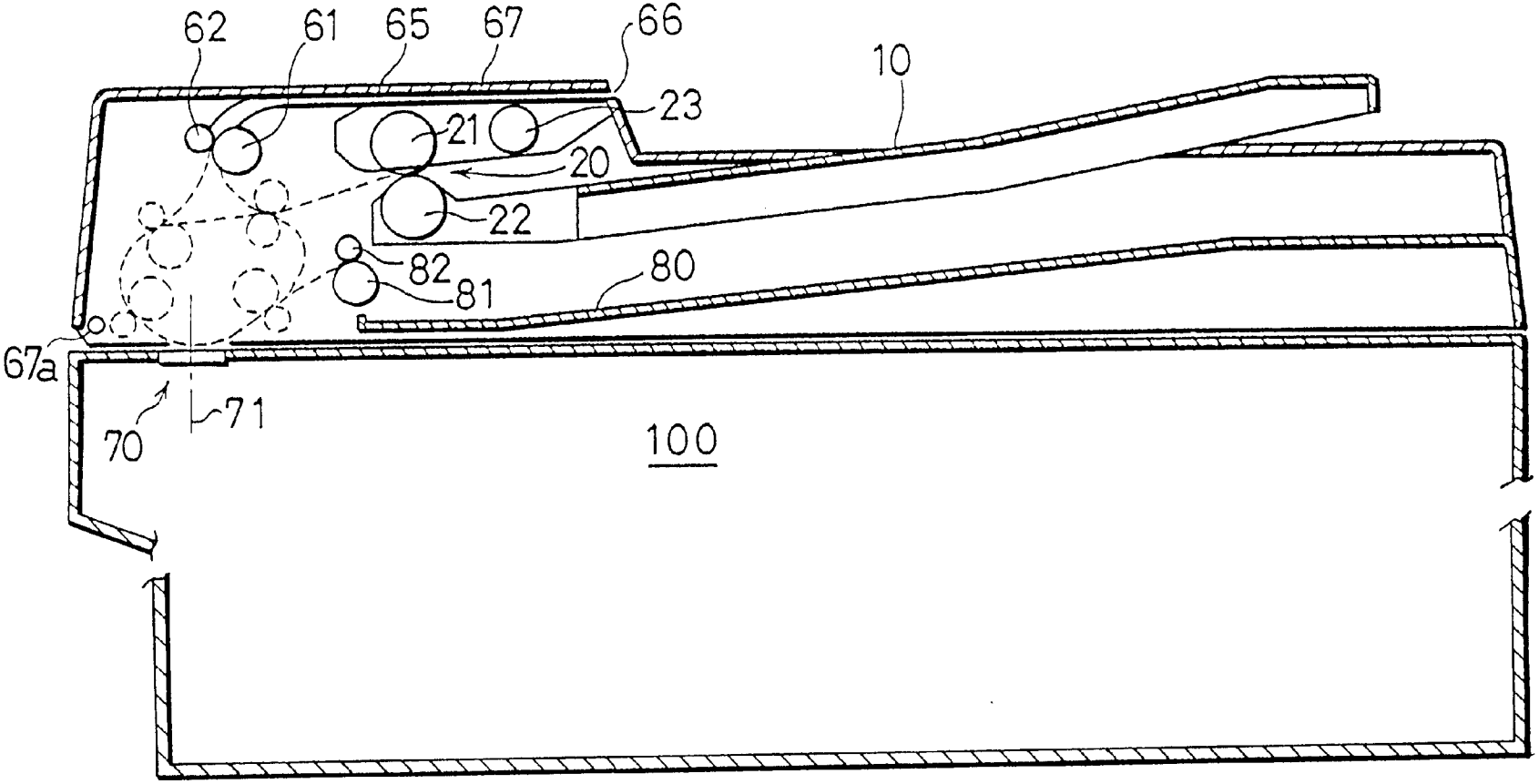
FIG. 5 is a diagram showing an image forming apparatus provided with a document scanner which incorporates a paper transport device according to the invention.

FIG. 5 is a diagram showing an image forming apparatus provided with a document scanner which incorporates a paper transport device according to the invention. The document scanner comprises a document tray 10 on which an original document is loaded, a switchback path 65 provided above the document tray 10 for temporarily holding a sheet of the document when reversing its feed direction during switchback operation, an image scanning device 70 for scanning an image on the document and a document output tray 80 provided below the document tray 10 for receiving each sheet of the document output upon completion of image scanning operation. The document scanner thus constructed feeds each sheet of the document along document paths shown by broken lines in FIG. 5 and scans images written on the document. Designated by the numeral 100 in FIG. 5 is an image forming unit combined with the document scanner having the aforementioned construction. Like the example of the prior art previously described with reference to FIG. 1, the image forming unit 100 incorporates the following constituent elements:

Paper feed section including a paper cassette

Fuser assembly provided downstream of the paper feed section

Paper output section provided downstream of the fuser assembly

Figure 6:
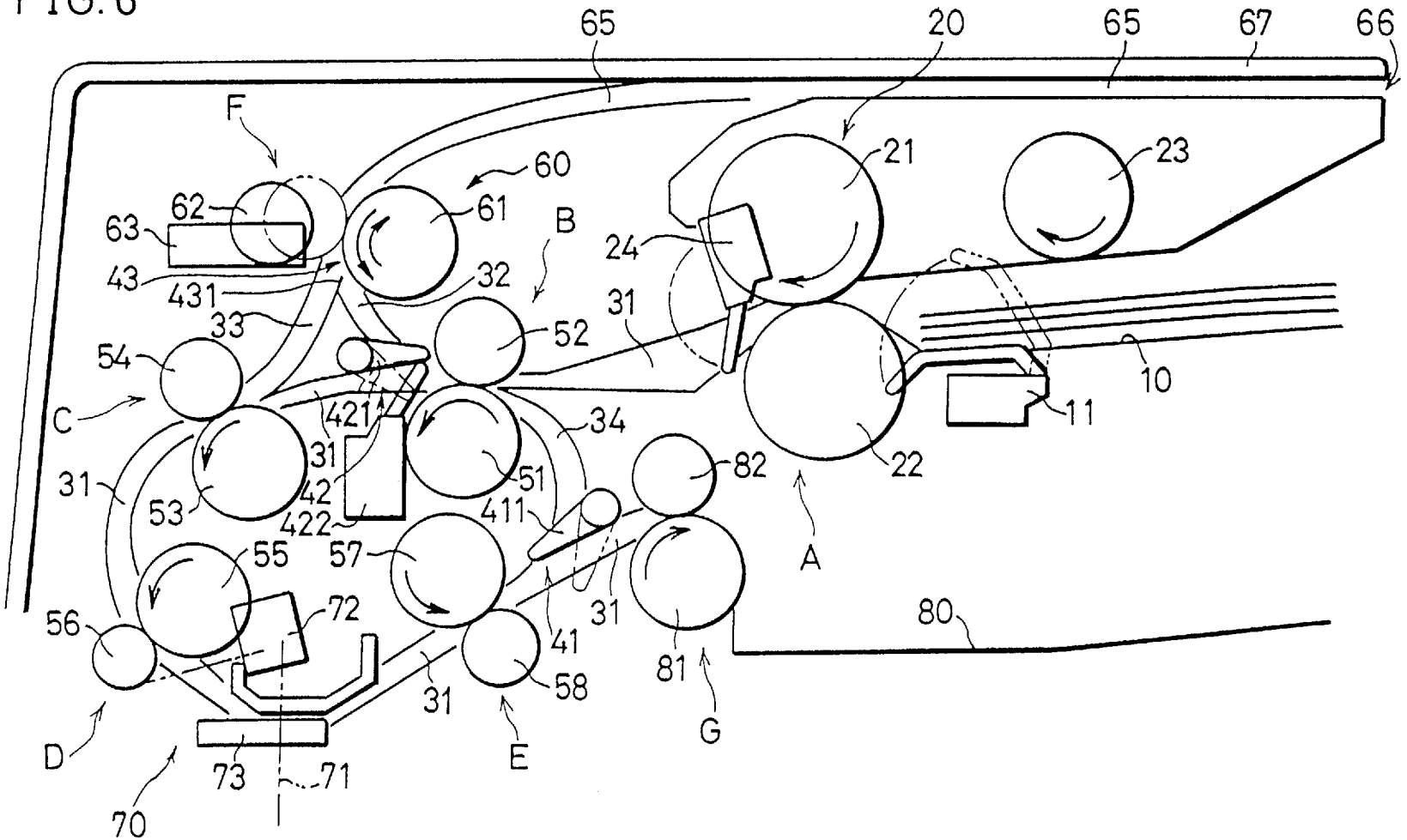
FIG. 6 is a diagram showing the internal construction of the document scanner in some detail.

FIG. 6 is a diagram showing the internal construction of the document scanner in some detail. Given below is a further description of the construction of the document scanner, followed by a detailed description of the construction of the paper transport device according to the invention.

B. Construction of Document Scanner

The document tray 10 is a document loading device on which multiple sheets of an original document, each sheet carrying image information on its one side or both sides, can be stacked. Referring to FIG. 6, a set document sensor 11 for sensing the document loaded on the document tray 10 is attached to a bottom part of the document tray 10.

On an outlet side of the document tray 10, there is provided a multiple sheet feed assembly 20 which is one principal portion of the paper transport device of the invention. The multiple sheet feed assembly 20 separates each successive sheet from a stack of the document loaded on the document tray 10 and feeds each sheet into a first document path 31. More specifically, a forward feed roller 23 provided just above the document tray 10 rotates to push each successive sheet of the document toward a document feed roller 21 (hereinafter also referred to as a first roller) and a separation roller 22 (also referred to as a second roller). The document feed roller 21 rotates to feed each sheet of the document into the first document path 31 while the separation roller 22 pressed by the document feed roller 21 rotates in a specific direction in accordance with a pressure applied by the document feed roller 21 to separate the uppermost sheet from the stack of the document on the document tray 10 and advance it toward the first document path 31. The separation roller 22 of this multiple sheet feed assembly 20 is a movable roller which can be brought into contact with and separated from the document feed roller 21. A detailed description of this mechanism will be given later.

The first document path 31 extends from the multiple sheet feed assembly 20 down to the document output tray (document output section) 80 by way of the image scanning device 70. There is provided a document reversing assembly 60 for turning a two-sided sheet of the document upside down between the multiple sheet feed assembly 20 and the image scanning device 70. There is a first branch point 41 from where a later-described fourth document path 34 branches out between the image scanning device 70 and the document output tray 80.

Now, the construction of individual elements of the document scanner is described along the first document path 31, from the multiple sheet feed assembly 20 to the document output tray 80. For the sake of explanation, the expression "upstream" is used to refer to the side of the first document path 31 closer to the multiple sheet feed assembly 20 while the expression "downstream" is used to refer to the side of the first document path 31 closer to the document output tray 80.

A feed sensor 24 is provided at an inlet point of the first document path 31, or in the vicinity of the multiple sheet feed assembly 20. The feed sensor 24 detects the leading edge and the trailing edge of a sheet of the document which is fed from the multiple sheet feed assembly 20 into the first document path 31.

On the downstream side of the feed sensor 24, there are provided a driving registration roller 51 and a driven registration roller 52 which rotates in contact with the registration roller 51. The registration roller 51 feeds the document at a lower speed than the document feed roller 21 so that the sheet of the document fed by the document feed roller 21 slackens on the upstream side of the registration roller pair 51, 52. The document feed roller 21 stops to rotate in this condition and the registration roller 51 begins to feed the sheet, whereby the leading edge of the sheet is properly aligned and the sheet is fed downstream along the first document path 31 with controlled timing.

The document reversing assembly 60 for turning the sheet of the document upside down is provided immediately downstream of the registration roller 51. The document reversing assembly 60 pulls the sheet fed through the first document path 31 into a second document path 32 which is directed upward from a second branch point 42, reverses the feed direction of the sheet by means of a pair of reversible rollers 61, 62 which can rotate in either a forward or reverse direction, and then returns the sheet back to the first document path 31 through a third document path 33. The document reversing assembly 60 turns the sheet upside down in this fashion.

The aforementioned document reversing operation for turning the sheet of the document upside down is performed only when the sheet carries image information on both sides. To make this possible, there is provided a document guide lever 421 at the second branch point 42 from where the second document path 32 branches out for switching the document path depending on whether the sheet is one-sided or two-sided. More specifically, if the sheet transferred to the second branch point 42 is one-sided, the document guide lever 421 is set to a position shown by a solid line in FIG. 6 so that the sheet is allowed to advance straight downstream along the first document path 31 without being guided into the second document path 32, that is, without entering the document reversing operation. If, however, the sheet fed from the document tray 10 is two-sided, the document guide lever 421 is set to a position shown by a broken line in FIG. 6 so that the sheet is guided into the second document path 32 and undergoes the aforementioned document reversing operation.

There is provided a branch point sensor 422 at the second branch point 42 for detecting both the leading edge and the trailing edge of each sheet of the document. With this branch point sensor 422, it is possible to detect whether the sheet has been transferred downstream along the first document path 31 with the document guide lever 421 set in the position shown by the solid line in FIG. 6 or the sheet has been guided into the second document path 32 with the document guide lever 421 set in the position shown by the broken line in FIG. 6.

The aforementioned reversible roller pair 61, 62 for reversing the document feed direction is located at an output point of the second document path 32. The driven reversible roller 62 situated face to face with the driving reversible roller 61 is associated with a reversible roller moving mechanism 63 which adjusts the position of the reversible roller 62. The reversible roller moving mechanism 63 makes it possible to switch the reversible roller pair 61, 62 between a nip position in which the two rollers 61, 62 nip and transfer the sheet of the document and a loose position in which the two rollers 61, 62 are separated from each other.

When the reversible roller pair 61, 62 is in the nip position, the sheet situated between the two rollers 61, 62 is transferred by rotary motion of the reversible roller 61 and, when the reversible roller 61 stops to rotate, the sheet remains nipped between the two rollers 61, 62. On the other hand, when the reversible roller pair 61, 62 is in the loose position, there is formed a clearance between the two rollers 61, 62. Thus, even when two sheets of the document exist between the rollers 61 and 62, one sheet overlying the other, neither of the rollers 61, 62 applies a pushing force to the sheets, allowing the two sheets to move freely in opposite directions.

The switchback path 65 for temporarily holding a sheet of the document when reversing its feed direction is located above the reversible roller pair 61, 62. The switchback path 65 rises upward from its document inlet located just between the two rollers 61, 62 and extends generally horizontally. There is provided a cover 67 (which may be considered a supporting member) above the switchback path 65 to cover the sheet of the document which has been guided into the switchback path 65. Referring to FIG. 5, the cover 67 can be opened and closed by swinging it about a pivot shaft 67*a*. In this construction, it is possible to open the cover 67 whenever it becomes necessary to deal with a jam to permit access to various roller pairs disposed within the paper transport device as will be described later in great detail. When the jammed sheet has been successfully removed, the cover 67 is closed and, then, ordinary document scanning operation can be resumed.

A portion of the switchback path 65 opposite to its document inlet located between the two rollers 61, 62 extends horizontally, immediately above the multiple sheet feed assembly 20, and opens outward at an opening 66 which is located at an outer end of the cover 67 above the document tray 10.

The sheet of the document guided into the switchback path 65 stops with its trailing edge nipped between the two rollers 61, 62. The length of the switchback path 65, as measured from the trailing edge of the sheet in this condition to the opening 66, is made equal to the length of the most common A4 paper size.

Situated immediately beneath the reversible roller pair 61, 62 is a third branch point 43 from where the aforementioned second document path 32 and third document path 33 branch out. There is provided a document guide 431 at the third branch point 43 for guiding the sheet transferred upward along the second document path 32 into the switchback path 65 and for guiding the sheet advanced downward from the switchback path 65 into the third document path 33. The document guide 431 is substantially a part of an underside wall of the third document path 33 that is extended upward to constrict an upper downstream end of the second document path 32.

The third document path 33 joins at its downstream end the first document path 31 so that the sheet which has been turned upside down and fed back from the switchback path 65 is returned to the first document path 31.

Provided downstream of the document reversing assembly 60 thus constructed is a pair of upper transfer rollers 53, 54 which are normally in contact with each other. The transfer roller 54 is a driving roller while the transfer roller 53 is a driven roller. Provided further downstream is a pair of lower transfer rollers 55, 56 which are normally in contact with each other. The transfer roller 55 is a driving roller while the transfer roller 56 is a driven roller. The upper transfer roller 53 is kept stopped when a two-sided sheet of the document turned upside down by the document reversing assembly 60 arrives after the switchback operation so that the sheet slackens on the upstream side of the upper transfer roller pair 53, 54. The upper transfer roller 53 begins to rotate from this condition, whereby the leading edge of the sheet is properly aligned and the sheet is fed further downstream.

The earlier-mentioned image scanning device 70, which scans images on the document transferred along the first document path 31, is situated downstream of the lower transfer roller pair 55, 56. The image scanning device 70 scans an image on the bottom side of the sheet of the document at a scanning position 71 as the sheet is transferred over a contact glass 73 which is provided at the top of a main body of the image forming unit 100. Start/stop timing of the document scanning operation of the image scanning device 70 is controlled based on signals output from a timing sensor 72 which is provided immediately upstream of the scanning position 71 and detects the leading edge and the trailing edge of the sheet. More specifically, an unillustrated image scanning mechanism is provided below the contact glass 73. This mechanism projects a light beam emitted from an exposure lamp, for instance, onto the bottom side of the sheet on the contact glass 73, guides reflected light to a charge-coupled device (CCD) array, for instance, by means of a lens system and mirrors, and scans the image.

Provided downstream of the image scanning device 70 is a pair of intermediate transfer rollers 57, 58 which are in contact with each other. The transfer roller 57 is a driving roller while the transfer roller 58 is a driven roller. The earlier-mentioned first branch point 41 from where the fourth document path 34 branches out is provided downstream of the intermediate roller pair 57, 58. The fourth document path 34 is a path for returning the two-sided sheet of the document whose one side has already been scanned but the reverse side remains to be scanned back to the first document path 31 on the upstream side of the document reversing assembly 60. To properly guide each sheet of the document, there is provided a document guide lever 411 at the first branch point 41. More specifically, when a two-sided sheet whose one side has been scanned arrives at the first branch point 41, the document guide lever 411 is set to a position shown by a broken line in FIG. 6 so that the sheet is guided into the fourth document path 34. When a two-sided sheet whose both sides have already been scanned arrives at the first branch point 41, the document guide lever 411 is set to a position shown by a solid line in FIG. 6 so that the sheet is guided further downstream along the first document path 31.

Situated immediately downstream of the first branch point 41 is an outlet of the first document path 31 facing the document output tray (document output section) 80 to which each sheet of the document is output upon completion of the document scanning operation. At the outlet of the first document path 31, there is provided a pair of output rollers 81, 82 which are in contact with each other. The output roller 81 is a driving roller while the output roller 82 is a driven roller.

C. Construction of Paper Transport Device

As thus far described, there are provided a number of roller pairs for gripping and advancing each sheet of the document in the document scanner. These include:

- Document feed roller pair 21, 22 (hereinafter referred to as the roller pair A)
- Registration roller pair 51, 52 (hereinafter referred to as the roller pair B)
- Upper transfer roller pair 53, 54 (hereinafter referred to as the roller pair C)
- Lower transfer roller pair 55, 56 (hereinafter referred to as the roller pair D)
- Intermediate roller pair 57, 58 (hereinafter referred to as the roller pair E)
- Reversible roller pair 61, 62 (hereinafter referred to as the roller pair F)
- Output roller pair 81, 82 (hereinafter referred to as the roller pair G)

Among these roller pairs A–G, the roller pairs except the roller pair D can be switched between a nip position and a loose position. The construction and switching operation of the roller pair A and the roller pairs B, C and E–G are separately described below.

C-1. Roller Pair A (Multiple Sheet Feed Assembly 20)

Figure 7:
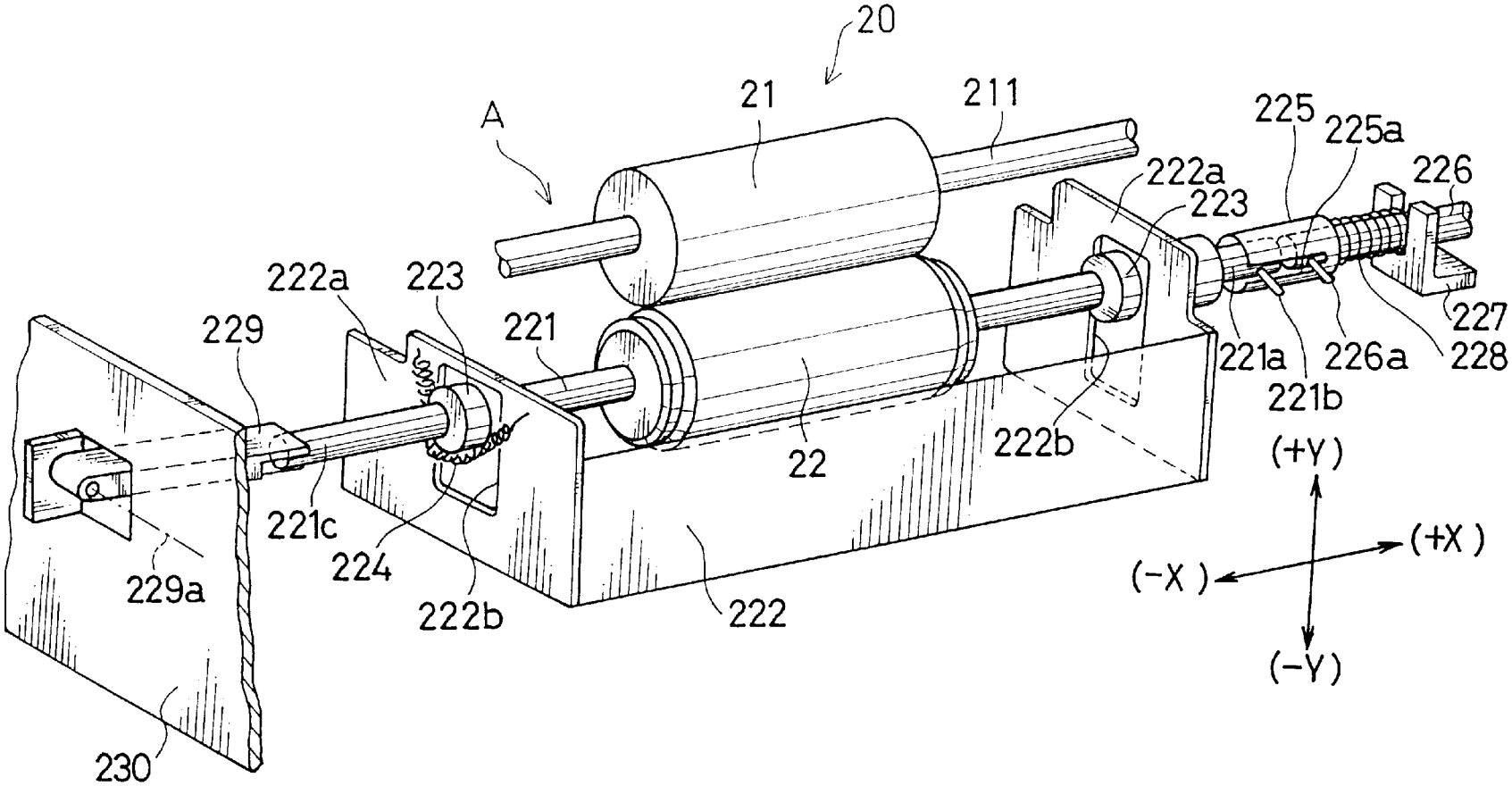
FIG. 7 is a perspective diagram showing the construction of a multiple sheet feed assembly which is one principal portion of the paper transport device according to a first embodiment of the invention.

FIG. 7 is a perspective diagram showing the construction of the multiple sheet feed assembly 20 which is one principal portion of the paper transport device according to a first embodiment of the invention. Inside the multiple sheet feed assembly 20, the document feed roller 21 is rotatably mounted on a rotary shaft 211 which extends in the direction (X-axis direction as illustrated) of the width of the document. Driven by an unillustrated drive motor, the document feed roller 21 rotates and feeds each successive sheet of the document stacked on the document tray 10.

The separation roller 22 is rotatably mounted on another rotary shaft 221 which extends approximately parallel to the axial direction (X-axis direction) of the document feed roller 21. The separation roller 22 is located face to face with the document feed roller 21 and forced against it. More particularly, the multiple sheet feed assembly 20 is constructed as described below. There is provided a roller bracket 222 for supporting the separation roller 22 beneath the document feed roller 21. Upright side plates 222*a* extend upward from both ends (in the X-axis direction) of the roller bracket 222, and vertically extending slots 222*b* (elongated in a Y-axis direction as illustrated) whose dimensions are greater than the diameter of the rotary shaft 221 are formed in the individual side plates 222*a*. The rotary shaft 221 on which the separation roller 22 is mounted passes through these slots 222*b* approximately parallel to the axial direction X of the document feed roller 21. Ringlike elements 223 whose diameter is slightly larger than the width of the slots 222*b* are fitted on the rotary shaft 221 near the slots 222*b*. Elastic elements 224 like coil springs, for example, sustain the ringlike elements 223 as shown in FIG. 7 to lift them upward (+Y direction), whereby the separation roller 22 is forced against the document feed roller 21. Since both ends of each elastic element 224 are hooked to the relevant side plate 222*a* and each ringlike element 223 is just suspended by a middle portion of each elastic element 224, the rotary shaft 221 can rotate freely.

One end 221*a* (located in the +X direction) of the rotary shaft 221 is connected to a drive shaft 226 via a coupler 225. Specifically, a projecting part 221*b* extending at right angles to the axial direction (X-axis direction) of the rotary shaft 221 is formed close to the end 221*a* of the rotary shaft 221, while a similar projecting part 226*a* is formed close to an inner end (located in the −X direction) of the drive shaft 226. The projecting part 226*a* is held in contact with a bottom of a slit 225*a* formed in the coupler 225, whereas the projecting part 221*b* is held approximately parallel to the projecting part 226*a* and loosely fit in the slit 225*a*. An outer end (located in the +X direction) of the coupler 225 is pushed inward (in the −X direction) by a coil spring 228 which is fitted over the drive shaft 226 between the coupler 225 and a drive shaft support 227.

On the other hand, one end of a connecting bar 229 (hereinafter also referred to as a shaft support) is joined to the other end 221*c* (located in the −X direction) of the rotary shaft 221 obliquely from above. The free end of the connecting bar 229 is formed with a recess 229*b* in a lower part of the free end (see FIGS. 8A and 8B). The other end 221*c* of the rotary shaft 221 is held in the recess 229*b*. The other end of the connecting bar 229 is attached to a support plate 230 which is fixed to the main body of the image forming unit 100 in such a way that the connecting bar 229 can swing about a pivot pin 229*a* (also referred to as a horizontal pin).

In this construction, the separation roller 22 is separated from the document feed roller 21 when the connecting bar 229 forcibly pushes one end 221*c* of the rotary shaft 221 downward overwhelming an upward-lifting force of the elastic elements 224, causing the rotary shaft 221 to swing down about the opposite end 221*a* which serves as a supporting point.

Figure 8A:
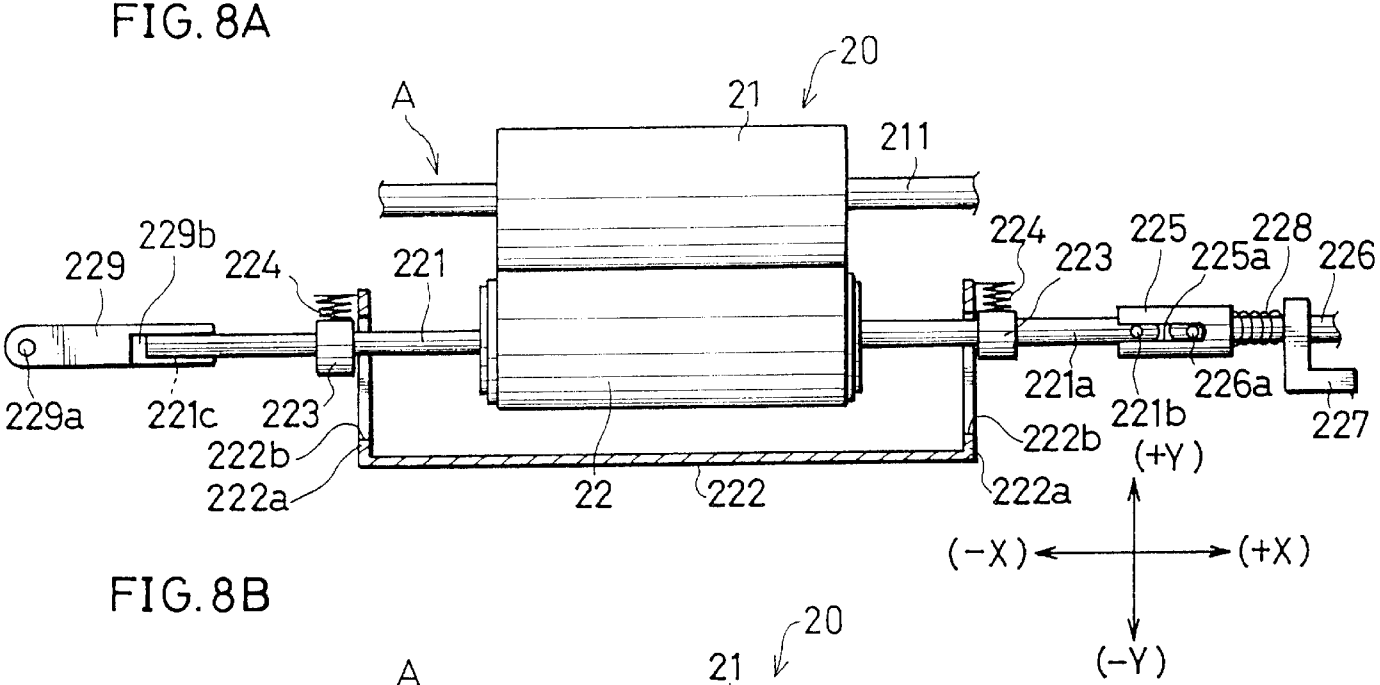
FIGS. 8A and 8B are diagrams showing the operation of the multiple sheet feed assembly of FIG. 7.
Figure 8B:
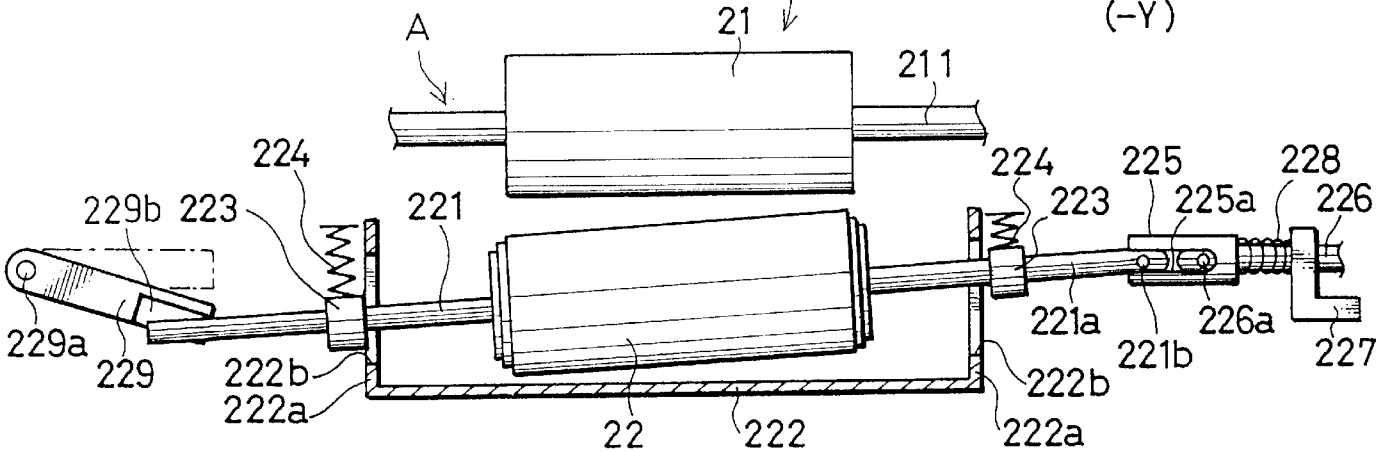

Operation of the multiple sheet feed assembly 20 thus constructed is now described referring to FIGS. 8A and 8B. Under normal conditions, there exists no external force exerted on the connecting bar 229 so that the separation roller 22 is held in contact with the document feed roller 21 as shown in FIG. 8A by the upward-lifting force (exerted in the +Y direction) of the elastic elements 224. Although not illustrated in FIG. 8A, a torque limiter is connected to the drive shaft 226 which is linked to the rotary shaft 221 of the separation roller 22 via the coupler 225. Thus, when a single sheet of the document is going to pass between the document feed roller 21 and the separation roller 22, the separation roller 22 is driven by the document feed roller 21 because the torque applied to the separation roller 22 is high. When more than one sheet of the document is going to pass between the document feed roller 21 and the separation roller 22, however, the torque limiter acts to prohibit the separation roller 22 from rotating because the torque applied to the separation roller 22 is low. In the latter case, the document feed roller 21 feeds only the uppermost sheet further downstream to prevent a paper feeding error known as multiple feed. This is because the friction force that occurs between individual sheets of the document is smaller than the friction force that occurs between the uppermost sheet and the separation roller 22. In this embodiment, the torque limiter is linked to one end 221*a* of the rotary shaft 221 via the coupler 225 to serve as means for controlling the rotation of the separation roller 22.

When any sheet of the document has jammed while it is being transferred through the multiple sheet feed assembly 20, the paper transport device is stopped and an operator opens the cover 67 to expose the connecting bar 229. Then, the operator pushes the connecting bar 229 downward (in the −Y direction) so that the rotary shaft 221 tilts down about the opposite end 221*a* of the rotary shaft 221. As a result, the separation roller 22 is separated from the document feed roller 21 as shown in FIG. 8B. There is formed a clearance between the document feed roller 21 and the separation roller 22 and, then, the operator can remove the sheet jammed between the two rollers 21, 22.

As described above, the operator can separate the separation roller 22 from the document feed roller 21 by moving one end 221*c* of the rotary shaft 221 downward so that the rotary shaft 221 swings about its opposite end 221*a* in the paper transport device of this embodiment, making it possible to deal with a document jam. Unlike the conventional paper transport device in which both ends of a roller are moved to separate it from another roller, the paper transport device of this embodiment is so simple in construction and less expensive, yet allowing easy removal of the sheet jammed between the document feed roller 21 and the separation roller 22.

Although the operator manually pushes the connecting bar 229 downward after opening the cover 67 in the construction of this embodiment, it may be modified such that the connecting bar 229 is moved downward in interlocked action with the opening of the cover 67.

Although the separation roller 22 moves downward (in the −Y direction) when the operator pushes the connecting bar 229 downward in this embodiment, the moving direction of the separation roller 22 need not necessarily be vertical. Instead, the paper transport device may be constructed such that the separation roller 22 can be moved in the upstream or downstream direction along the document feed direction (that is, in a direction perpendicular to the page of FIGS. 8A and 8B), for example.

Furthermore, although the operator separates the separation roller 22 from the document feed roller 21 by moving one end 221*c* of the rotary shaft 221 downward so that the rotary shaft 221 swings about its opposite end 221*a* in the foregoing embodiment, the paper transport device may be constructed such that the document feed roller 21 is caused to swing instead of the separation roller 22. In this varied form of the embodiment, a drive motor is connected to one end (located in the +X direction) of the drive shaft 226 and a driving force of the drive motor is transmitted to the rotary shaft 211 of the document feed roller 21 via the drive shaft 226 and the coupler 225 which are joined to the rotary shaft 211.

Although the invention has thus far been described as being embodied in the paper transport device constructed mainly of the roller pair A including the document feed roller 21 and the separation roller 22 in the foregoing embodiment, it is needless to say that the invention is also applicable to the other roller pairs of the document scanner shown in FIGS. 5 and 6 as well as to roller pairs incorporated in the image forming unit 100. When the driven roller which is driven to rotate by the driving roller of a particular roller pair should be constructed in a similar fashion to the separation roller 22, that is, when the driven roller is to be made separable from the driving roller by swinging one end of the rotary shaft of the driven roller about the other end of the rotary shaft, the former end of the rotary shaft may be made freely movable.

C-2. Roller Pairs B, C, E–G

Figure 9:
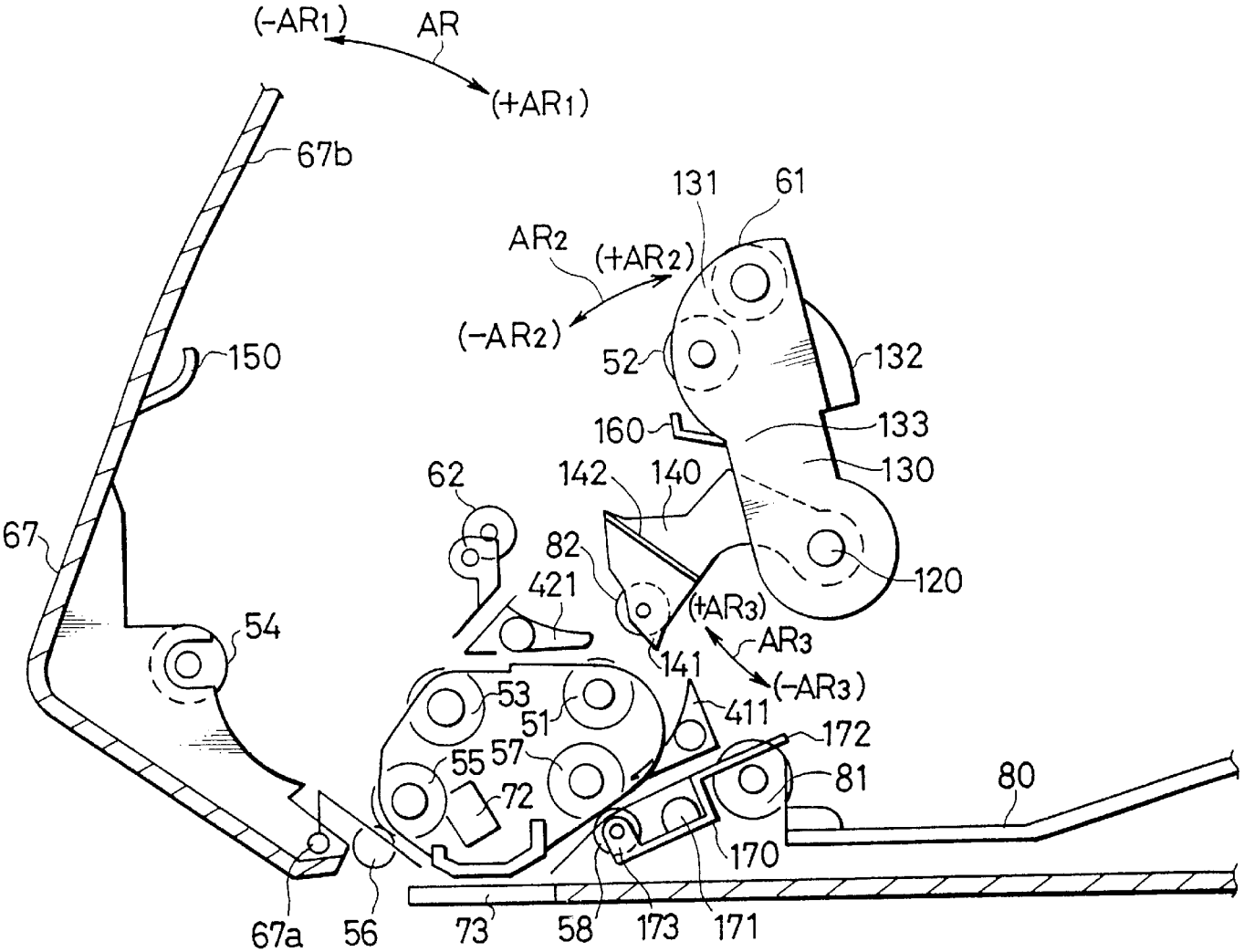
FIG. 9 is a diagram showing another principal portion of the paper transport device of the document scanner according to a second embodiment of the invention, in which a cover of the paper transport device is opened and rollers are in their loose positions.
Figure 10:
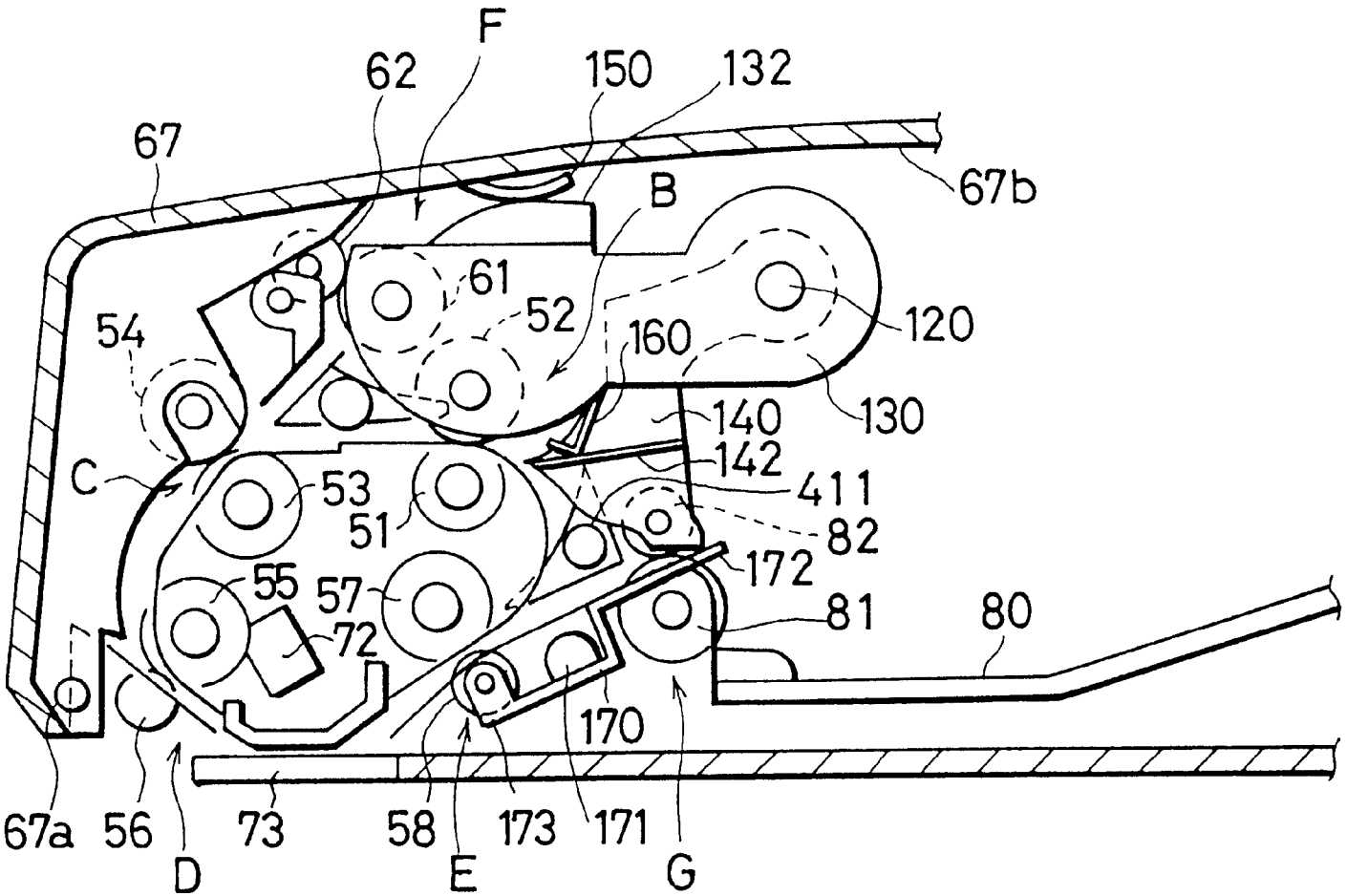
FIG. 10 is a diagram showing the portion of the paper transport device of FIG. 9, in which the cover is closed and the rollers are set to their nip positions.

FIGS. 9 and 10 are diagrams showing another principal portion of the paper transport device of the document scanner according to a second embodiment of the invention. More specifically, FIG. 9 is a diagram showing the principal portion of the paper transport device whose cover 67 is opened and rollers are in their loose positions, and FIG. 10 is a diagram showing the principal portion of the paper transport device of FIG. 9, in which the cover 67 is closed and the rollers are set to their nip positions.

Referring to FIG. 9, the cover 67 can be opened and closed as shown by a double arrow AR by swinging it about the pivot shaft 67*a*. The upper transfer roller 54 of the roller pair C is mounted on an inside surface 67*b* of the cover 67. When the cover 67 is opened by swinging it up in the direction of arrowhead −AR1, the upper transfer roller 54 is greatly separated from the upper transfer roller 53 which is fixed in the vicinity of the first document path 31 as illustrated. In this embodiment, access to the interior of the paper transport device is obtained by simply opening the cover 67, whereby the upper transfer rollers 53, 54 of the roller pair C are separated from each other and a sheet of the document jammed between the roller pair C can be easily removed. When the cover 67 is closed by swinging it down in the direction of arrowhead +AR1 as shown in FIG. 10, the driven roller 54 is pressed against the driving roller 53, whereby the roller pair C is set to its nip position.

As depicted in FIG. 9, roller brackets 130 and 140 are mounted on a common pivot shaft 120 swingably about it in directions shown by double arrows AR2 and AR3, respectively. Roller bracket 130 may be considered a supporting member. The reversible roller 61 and the registration roller 52 are rotatably mounted at a terminal portion 131 of the roller bracket 130. If the roller bracket 130 is swung in the direction of arrowhead +AR2 after opening the cover 67 as shown in FIG. 9, the reversible roller 61 and the registration roller 52 are greatly separated from the reversible roller 62 and the registration roller 51, respectively. If the roller bracket 130 is swung in the direction of arrowhead −AR2 when the cover 67 is open, the reversible roller 61 and the registration roller 52 move toward and come in contact with the reversible roller 62 and the registration roller 51, respectively. Then, if the cover 67 is closed in the direction of arrowhead +AR1 in this condition as shown in FIG. 10, an elastic member 150 which is formed of a leaf spring, for example, and attached to the inside surface 67*b* of the cover 67 is pressed against an upper surface 132 of the roller bracket 130. As a consequence, the reversible roller 61 and the registration roller 52 are pressed against the reversible roller 62 and the registration roller 51, respectively, whereby the roller pairs B and F are set to their nip positions. Although the elastic member 150 formed of a leaf spring, for example, is attached to the inside of the cover 67 to hold the driving and driven rollers 51–52, 61–62 of the roller pairs B and F in tight contact in this embodiment, a flexible pushing element similar to the elastic member 150 may be provided on the upper surface 132 of the roller bracket 130.

As already stated, the other roller bracket 140 is mounted swingably on the pivot shaft 120 jointly with the roller bracket 130. The output roller 82 is rotatably mounted at a terminal portion 141 of the roller bracket 140. If the roller bracket 140 is swung in the direction of arrowhead +AR3 with the roller bracket 130 already swung in the direction of arrowhead −AR2 when the cover 67 is open as shown in FIG. 9, the output roller 82 is greatly separated from the output roller 81. If the roller bracket 140 is swung in the direction of arrowhead −AR3 with the roller bracket 130 already swung in the direction of arrowhead −AR2 when the cover 67 is open, the output roller 82 moves toward and comes in contact with the output roller 81. Then, if the roller bracket 130 is swung in the direction of arrowhead −AR2 and the cover 67 is closed in the direction of arrowhead +AR1 in this condition as shown in FIG. 10, an elastic member 160 which is formed of a leaf spring, for example, and projects from a middle portion of a bottom surface 133 of the roller bracket 130 is pressed against a hold-down flange 142 provided in a middle portion of the roller bracket 140. As a consequence, the driven output roller 82 is pressed against the driving output roller 81, whereby the roller pair G is set to its nip position. Although the elastic member 160 formed of a leaf spring, for example, and projecting from the middle portion of the bottom surface 133 of the roller bracket 130 is attached to the roller bracket 130, a flexible pushing element similar to the elastic member 160 may be provided on the roller bracket 140.

There is provided an elastic member 170 between the output roller 81 and the intermediate roller 58 as shown in FIG. 9. When a tip end of the terminal portion 141 comes into contact with the elastic member 170 as shown in FIG. 10, the driven intermediate roller 58 is forced against the driving intermediate roller 57. More specifically, the elastic member 170 is formed of a leaf spring, for example, and supported by a fulcrum 171 which is situated approximately at a central part of the elastic member 170. When the roller bracket 140 is swung in the direction of arrowhead −AR3, the tip end of the terminal portion 141 of the roller bracket 140 comes into contact with one end 172 of the elastic member 170. On the other hand, the intermediate roller 58 is rotatably mounted at the other end 173 of the elastic member 170. When the cover 67 is opened and the roller brackets 130 and 140 are successively swung up in the directions of arrowheads +AR2 and +AR3, respectively, the terminal portion 141 of the roller bracket 140 is separated from the elastic member 170 and, at this point, a pushing force which has been exerted by the elastic member 170 on the intermediate roller 58 is completely eliminated. On the contrary, when the roller bracket 140 is swung down in direction of arrowhead −AR3, causing the output roller 82 to go into contact with the output roller 81, and the cover 67 is closed with the roller bracket 130 swung down in direction of arrowhead −AR2 in succession, the terminal portion 141 of the roller bracket 140 pushes one end 172 of the elastic member 170 down. As a consequence, the intermediate roller 58 mounted at the other end 173 of the elastic member 170 is forced upward against the intermediate roller 57, whereby the roller pair E is set to its nip position.

Explained below is how document jams occurring in the paper transport device constructed as shown in FIGS. 9 and 10 are dealt with. When a document jam has occurred, the operator opens the cover 67 by swinging it up in the direction of arrowhead -ARI about the pivot shaft 67*a*. The roller pairs B, C, E, F and G are successively relieved of their nip positions and set to the loose positions in the following fashion.

First, the upper transfer roller 54 fixed to the cover 67 is greatly separated from the upper transfer roller 53, whereby the two rollers 53, 54 of the roller pair C are relieved of their tight contact.

Since the roller bracket 130 which has been forced down in position by the elastic member 150 fixed to the cover 67 is released when the cover 67 is opened, the reversible roller 61 and the registration roller 52 mounted at the terminal portion 131 of the roller bracket 130 is separated from the reversible roller 62 and the registration roller 51, respectively, whereby the rollers 51–52, 61–62 of the roller pairs B and F are relieved of their tight contact.

Then, the roller bracket 140 which has been forced down in position by the cover 67 via the elastic member 150, the roller bracket 130 and the elastic member 160 is set free and, consequently, the output roller 82 mounted at the terminal portion 141 of the roller bracket 140 is no longer forced against the output roller 81, whereby the two rollers 81, 82 of the roller pair G are relieved of their tight contact.

Although the terminal portion 141 of the roller bracket 140 still remains in contact with one end 172 of the elastic member 170, the terminal portion 141 does not push against the end 172 of the elastic member 170 at this point. Thus, the intermediate roller 58 mounted at the other end 173 of the elastic member 170 is no longer forced against the intermediate roller 57, whereby the two rollers 57, 58 of the roller pair E are relieved of their tight contact.

It would be recognized from the foregoing discussion that only when the roller pair C is relieved of its nip position by opening the cover 67, the roller pairs B, E, F and G are automatically relieved of their tight contact in this embodiment. Opening the cover 67 in the case of a document jam provides a wide-open space to allow easy access to the interior of the paper transport device, making it easier to deal with the jam. Furthermore, because the roller brackets 130 and 140 are swingably mounted on the pivot shaft 120, it is possible not only to easily relieve the roller pairs B, E, F and G of their tight contact but also to provide even wider space for dealing with the jam by just swinging the roller brackets 130 and 140 in the +AR2 and +AR3 directions, respectively, to greatly separate the rollers 61, 52 and 82 from their corresponding rollers 62, 51 and 81. This would make it even easier to deal with the jam.

After removing any sheet of the document jammed in the paper transport device, the operator closes the cover 67 by swinging it down in the direction of arrowhead +AR1 about the pivot shaft 67*a*. Then, the roller pairs B, C, E, F and G are brought back to their nip positions in the following fashion. If the roller brackets 130 and 140 have been swung in the +AR2 and +AR3 directions, respectively, as described above, the operator should swing the roller bracket 140 back in the −AR3 direction and the roller bracket 130 back in the −AR2 direction in this order before closing the cover 67.

When the cover 67 is closed, the upper transfer roller 54 is pressed against the upper transfer roller 53, whereby the roller pair C is set to its nip position.

Since the elastic member 150 attached to the inside surface 67*b* of the cover 67 pushes against the upper surface 132 of the roller bracket 130, the reversible roller 61 and the registration roller 52 are forced against the reversible roller 62 and the registration roller 51, respectively, whereby the roller pairs B and F are set to their nip positions.

The elastic member 160 projecting from the middle portion of the bottom surface 133 of the roller bracket 130 is also pressed against the hold-down flange 142 provided in the middle portion of the roller bracket 140 and, as a consequence, the output roller 82 is pressed against the output roller 81, whereby the roller pair G is set to its nip position.

Further, since the tip end of the terminal portion 141 pushes one end 172 of the elastic member 170 down, the elastic member 170 forces the intermediate roller 58 upward against the intermediate roller 57, whereby the roller pair E is set to its nip position.

As will be understood from the foregoing discussion, the roller pairs B, E, F and G can be automatically set to their nip positions only when the roller pair C is set to its nip position by closing the cover 67 in this embodiment.

Although the roller pairs B, E, F and G (secondary roller pairs) are switched between their nip positions and loose positions in interlocked action with the opening and closing of the cover 67 using the roller pair C as a primary roller pair in the above-described embodiment, it may be modified such that the roller pairs A and D can also be switched between their nip positions and loose positions. Furthermore, any roller pair other than the roller pair C may be used as a primary roller pair. In this case, the paper transport device should be constructed such that rollers of each roller pair other than the primary roller pair are brought into tight contact with each other when the primary roller pair is switched from its loose position to nip position and rollers of each roller pair other than the primary roller pair are relieved of their tight contact when the primary roller pair is switched from its nip position to loose position.

While the invention has been discussed with reference to the paper transport device incorporated in the document scanner hereinbefore, it is possible to apply the invention to other types of image forming apparatus incorporating a paper transport device for feeding sheets of paper, such as printers and copying machines. The invention, if embodied in these apparatus, will make it possible to remove paper jammed in the paper transport device during paper feed operation with a simple construction.

What is claimed is:

1. A paper transport device comprising:

a first roller pair including two first rollers arranged parallel to each other, said first rollers being movable into tight contact with each other and being displaceable from said tight contact by application of an external force;

a second roller pair including two second rollers arranged parallel to each other, said second rollers being movable into tight contact with each other when said first rollers are brought into tight contact with each other, and said second rollers being displaceable form said tight contact when said first rollers are displaced from said tight contacts;

a supporting member for rotatably supporting one of said second rollers, said supporting member being swingable about a pivot axis so that said one of said second rollers supported by said supporting member is movable into contact with or apart from another of said second rollers; and a leaf spring having one end attached to said supporting member for biasing said supporting member in a direction in which said one of said second rollers separates from said another one of said second rollers.

2. The paper transport device according to claim 1, further comprising:

a third roller mounted at a specified position; and a fourth roller mounted on a rotary shaft extending substantially parallel to a longitudinal direction of said third roller, a first end of said rotary shaft being movable in a direction approximately perpendicular to the longitudinal direction of said third roller so that said fourth roller is movable into contact with or apart from said third roller.

3. The paper transport device according to claim 2, further comprising:

a rotation controller for controlling the rotation of said fourth roller; and a coupler connecting said rotation controller to said first end of said rotary shaft.

4. The paper transport device according to claim 2, wherein a second end of said rotary shaft is set movable in a direction substantially parallel to a longitudinal direction of said third roller.

5. The paper transport device according to claim 2, further comprising a shaft support which supports said first end of said rotary shaft and is pivotable about its end point.

6. The paper transport device according to claim 5, further comprising a horizontal pin for pivotally supporting said shaft support, said horizontal pin being connected to a body of the paper transport device.

7. The paper transport device according to claim 6, wherein said horizontal pin extends in a direction perpendicular to a longitudinal direction of said third roller.

8. The paper transport device according to claim 5, wherein said shaft support has a space portion in a lower part of one end thereof for supporting said first end of said rotary shaft.

9. The paper transport device according to claim 8, further comprising an elastic element for biasing said rotary shaft upward.

10. The paper transport device according to claim 9, wherein said elastic element is an U-shaped coil spring having both ends fixed onto a roller housing so that said rotary shaft is supported along a circumferential surface of said U-shaped coil spring.

11. The paper transport device according to claim 1, further comprising a cover attached to an upper part of the paper transport device in such a manner that said cover is openable and closeable, one of said first rollers being rotatably mounted on an inside surface of said cover and movable into tight contact with another one of said first rollers when said cover is closed, and said first rollers being displaceable from said tight contact when said cover is opened.

12. The paper transport device according to claim 1, further comprising:

a pivot shaft defining said pivot axis about which said supporting member is swingable; and a roller bracket rotatably mounted on said pivot shaft.

13. The paper transport device according to claim 12, wherein said roller bracket comprises a flange, said roller bracket and said supporting member being arranged such that said leaf spring presses against said flange when said second rollers are in contact with one another.

14. A paper transport device comprising:

a first roller pair including two first rollers arranged parallel to each other, said first rollers being movable into tight contact with each other and displaceable from said tight contact by application of an external force;

a second roller pair including two second rollers arranged parallel to each other, said second rollers being movable into tight contact with each other when said first rollers are moved into tight contact with each other, and said second rollers being displaceable from said tight contact when said first rollers are displaced from their tight contact;

a first supporting member for rotatably supporting one of said first rollers, said first supporting member being swingable about a specific pivot axis so that said one of said first rollers is movable into contact with or apart from another one of said first rollers;

a second supporting member for rotatably supporting one of said second rollers, said second supporting member being swingable about a specific pivot axis so that said one of said second rollers is movable into contact with or apart from another one of said second rollers;

a first elastic member having a first end fixed to said first supporting member and a second end free from attachment; and a second elastic member having a first end fixed to said second supporting member and a second end free from attachment.

15. The paper transport device according to claim 14, wherein at least one of said first elastic member and said second elastic member is in a form of a leaf spring.

16. The paper transport device according to claim 14, wherein both said first elastic member and said second elastic member are in a form of a leaf spring.

17. The paper transport device according to claim 14, wherein said first supporting member is arranged to push against said second supporting member via said first elastic member when said first rollers are moved into contact with each other causing said second rollers to be moved into contact with each other.

18. The paper transport device according to claim 14, wherein said second elastic member is a leaf spring biasing said second supporting member in a direction in which said one of said second rollers separates from said another one of said second rollers.

19. The paper transport device according to claim 14, further comprising:

a pivot shaft defining said pivot axis about which said second supporting member is swingable; and a roller bracket rotatably mounted on said pivot shaft.

20. The paper transport device according to claim 19, wherein said roller bracket comprises a flange, and said roller bracket and said second supporting member are arranged such that said second elastic element presses against said flange when said second rollers are in contact with one another.

* * * * *